US007704114B2

(12) United States Patent
Tseng et al.

(10) Patent No.: US 7,704,114 B2
(45) Date of Patent: Apr. 27, 2010

(54) GATE CONTROLLED FIELD EMISSION TRIODE AND PROCESS FOR FABRICATING THE SAME

(75) Inventors: Tseung-Yuen Tseng, Hsinchu (TW); Chia-Ying Lee, Xinzhuang (TW); Seu-Yi Li, Zhubei (TW); Pang Lin, Hsinchu (TW)

(73) Assignee: National Chiao-Tung University, Hsinchu (TW)

( * ) Notice: Subject to any disclaimer, the term of this patent is extended or adjusted under 35 U.S.C. 154(b) by 518 days.

(21) Appl. No.: 11/642,271

(22) Filed: Dec. 20, 2006

(65) Prior Publication Data

US 2007/0284573 A1 Dec. 13, 2007

(30) Foreign Application Priority Data

Jun. 13, 2006 (TW) ..... 95120938 A

(51) Int. Cl.
*H01J 9/00* (2006.01)

(52) U.S. Cl. ..... 445/23; 445/51

(58) Field of Classification Search ..... 438/20; 977/811; 445/23–25, 49–51; 257/10
See application file for complete search history.

(56) References Cited

U.S. PATENT DOCUMENTS 6,015,326 A 1/2000 Potter 7,491,423 B1 * 2/2009 Hsu et al. ..... 427/261

FOREIGN PATENT DOCUMENTS

| | | |
|---|---|---|
| CN | 1526644 | 9/2004 |
| TW | 1248626 | 10/2004 |

OTHER PUBLICATIONS

"Sequential Nucleation and Growth of Complex Nanostructured Films" Sounart et al., Advance Functional Materials, 2006, 16, pp. 335-344.*

* cited by examiner

*Primary Examiner*—Joseph L Williams
(74) *Attorney, Agent, or Firm*—Buckman and Archer

(57) ABSTRACT

This invention relates to a process for fabricating ZnO nanowires with high aspect ratio at low temperature, which is associated with semiconductor manufacturing process and a gate controlled field emission triode is obtained. The process comprises providing a semiconductor substrate, depositing a dielectric layer and a conducting layer, respectively, on the semiconductor substrate, defining the positions of emitter arrays on the dielectric layer and conducting layer, depositing an ultra thin ZnO film as a seeding layer on the substrate, growing the ZnO nanowires as the emitter arrays by using hydrothermal process, and etching the areas excluding the emitter arrays, then obtaining the gate controlled field emission triode.

4 Claims, 9 Drawing Sheets

GATE CONTROLLED FIELD EMISSION TRIODE AND PROCESS FOR FABRICATING THE SAME

FIELD OF THE INVENTION

The present invention relates to a method for fabricating field emission elements with high aspect ratio ZnO synthesized by low temperature processing technique, and particularly to a method for significantly improving the field emission ability of field emission triode.

BACKGROUND OF THE INVENTION

Currently, the fabrication of field emission emitter of optoelectronic device mainly employs the association of lithography and etching process of the typical semiconductor manufacturing for making the pyramidal emitter. However, this method could not fabricate field emission elements with high aspect ratio, and thus could not provide high field enhancement factor for the field emission emitter implemented in optoelectronic device accordingly. Therefore, it would normally require higher driving voltage for the emitter to trigger the electrons. Some relevant researches employed the high aspect ratio nano-structure as the field emitter, such as carbon nanotubes or other semiconductor nanorods, so it could reduce the driving voltage because of providing high field enhancement factor. However, for the fabrication of these material, they comprise step of growing process under high temperature (>500° C.), so they are not easily integrated into the semiconductor process. Simultaneously, they lack of sufficient uniformity reaction for large area production, and are not suitable for the fabrication of large-scale device.

For example, the Taiwanese Patent No. 1,248,626 discloses the use of carbon nanotubes as the emitter of field emission device, wherein the fabrication method comprises firstly growing a catalyst metal layer, such as Fe, Co, Ni on a substrate; then, introducing a carbon source gas and heating to about 700° C. of reaction temperature; and producing the carbon nanotubes array as the cathode electrode in the presence of catalyst. The problems of prior art at least include: employing high pollution metals, such as Fe, Co, Ni, in the semiconductor process, wherein these metals are easy to make the control device failed and to contaminate the processing pipes; and increasing the processing cost due to high reaction temperature.

Thus, in order to acquire the high aspect ratio nano-structure as the field emitter but avoid the disadvantages of high processing temperature (>500° C.), the ZnO nanowires are fabricated by the low temperature processing technology in this invention. Particularly, the ZnO based field emission emitter capable of exhibiting excellent emission efficiency at room temperature now becomes more important. On the other hand, if employing the carbon tubes or one-dimensional nanorods in a non-oxide system, they will frequently react with the gas in the field emission device at the same time when electrons trigger, so as to damage the field emission device during operation. Moreover, in the ordinary processing for field emission device, the aspect ratio for the emitter material is constricted after fabrication, there is less possibility to improve the field emission characteristics.

SUMMARY OF INVENTION

The object of the present invention is to provide a method for fabricating ZnO nanowires with high aspect ratio as the emitter under low temperature, which could be integrated with the semiconductor process to obtain a gate controlled field emission triode. The method for fabricating ZnO nanowires is the hydrothermal process to be associated with the semiconductor process under the appropriate conditions suitable for nano growth. Thus, the method could provide the advantages over the prior arts for low reaction temperature, low pollution, high effective and uniform area, and for large-scale fabrication. Also, because the method has simplified the process, both the difficulty of fabrication and the cost will be reduced therewith. Furthermore, the controllable field emission performance of the ZnO nanowires triode can be enhanced by illumination and argon ion bombardment.

The method for fabricating gate controlled field emission triode according to the present invention at least includes the following steps: (1) providing a semiconductor substrate; (2) depositing a gate dielectric layer and a conductive layer on the substrate respectively; (3) defining the location for emitter array by photolithography and buffer oxide etching; (4) depositing ZnO seed layer (5) using the hydrothermal method to grow ZnO nanowires emitter array; and, (6) striping the photoresistance layer to obtain the gate controlled field emission triode.

The semiconductor substrate set forth in Step (1) is used as support base, and especially, the material of the substrate should be able to endure the temperature for typical semiconductor process. The preferred substrate is selected from the group containing metal substrate, flexible substrate, glass, quartz, and silicon substrate. For the benefits of the following deposition process, cleaning process is preferably conducted on the surface of the substrate with chemical solution, so as to improve the adhesion between the thin film and the substrate, and the reliability of field emission device.

The deposition of a dielectric layer and a conductive layer in Step (2) is to deposit a dielectric layer with material, such as silicon dioxide, as a spacer between the gate and the anode area; then, depositing the conductive film, like metallic film, and the oxide film with low resistance as the gate conductive layer.

Furthermore, the defined location for emitting array in Step (3) employ the ordinary photolithography, such as exposure, developing and etching. Especially, the location for emitter array is generated with the pits formed by etching, which is to employ the previous mask after development as shielding to deposit the ZnO film at the pits as the seed of ZnO nanorod in the hydrothermal process, in which the deposition thickness for the ZnO film is 5~100 nm.

The growth of ZnO nanowires in the hydrothermal process in Step (5) employs the characteristics of the hydrothermal method for naturally selective growth to grow the ZnO nanowires at the pits. The growth of ZnO nanowires in the hydrothermal process includes: immersing the substrate plated with the seed in the aqueous solution containing zinc nitrate and hexa hydrate ($Zn(NO_3).6(H_2O)$) and diethylenetriamine (HMTA), $C_6H_{12}N_4$ (0.01~0.5M), and using the heater to maintain the stable reaction temperature at 75~95° C. and the reaction time is 0.5~3 hours, wherein the method for controlling the components, geometric shape or structure includes using the salt-type ion solution as the dopant in the preparation process of the solution, and adjusting the processing parameters for control, such as pH value.

The method for fabricating gate controlled field emission triode according to the present invention further includes, after completion of gate controlled field emission triode, selectively employing plasma treatment to form doped ZnO nanowires, which could assist the nanowires with the doping ions, such as phosphorous having increased conductivity, The method for fabricating gate controlled field emission triode according to the present invention further includes, after completion of gate controlled field emission triode, i.e. after Step (5), using Ar ion to bombard the ZnO nanowires for reducing the tip radius of the nanowires to further enhance the field enhancement factor and the field emission characteristic. The Ar ion bombardment is performed under Ar atmosphere at the pressure controlled ranging $10^{-4}$~$10^{-1}$ Torr, and is conducted with field emission cycle at 1~100 times.

Regarding to the hydrothermal process for fabricating ZnO nanorods, as disclosed in Chinese Patent Publication No. 1,526,644, it employs the inorganic Zn salt as the material to form the precipitates in the soluble carbonate or hydrogen bicarbonate solution, and provides the hydrothermal reaction at a temperature of 180~220° C. to obtain the ZnO nanorods with different diameters 50~100 nm. However, because this patent and the like employ the hydrothermal method to fabricate the ZnO based nano material, and the nano product is at variously uncontrollable forms, such as linear, tube, rod, sphere, oval or the combination, and has not high aspect ratio and is not vertically grown on the substrate, these forms are substantially with different sized and disordered orientations, and are not suitable for the field emission emitter of optoelectronic device, and not stable compliant with the specification required for high field enhancement factor.

DETAILED DESCRIPTION OF PREFERRED EMBODIMENTS

Figure 1:
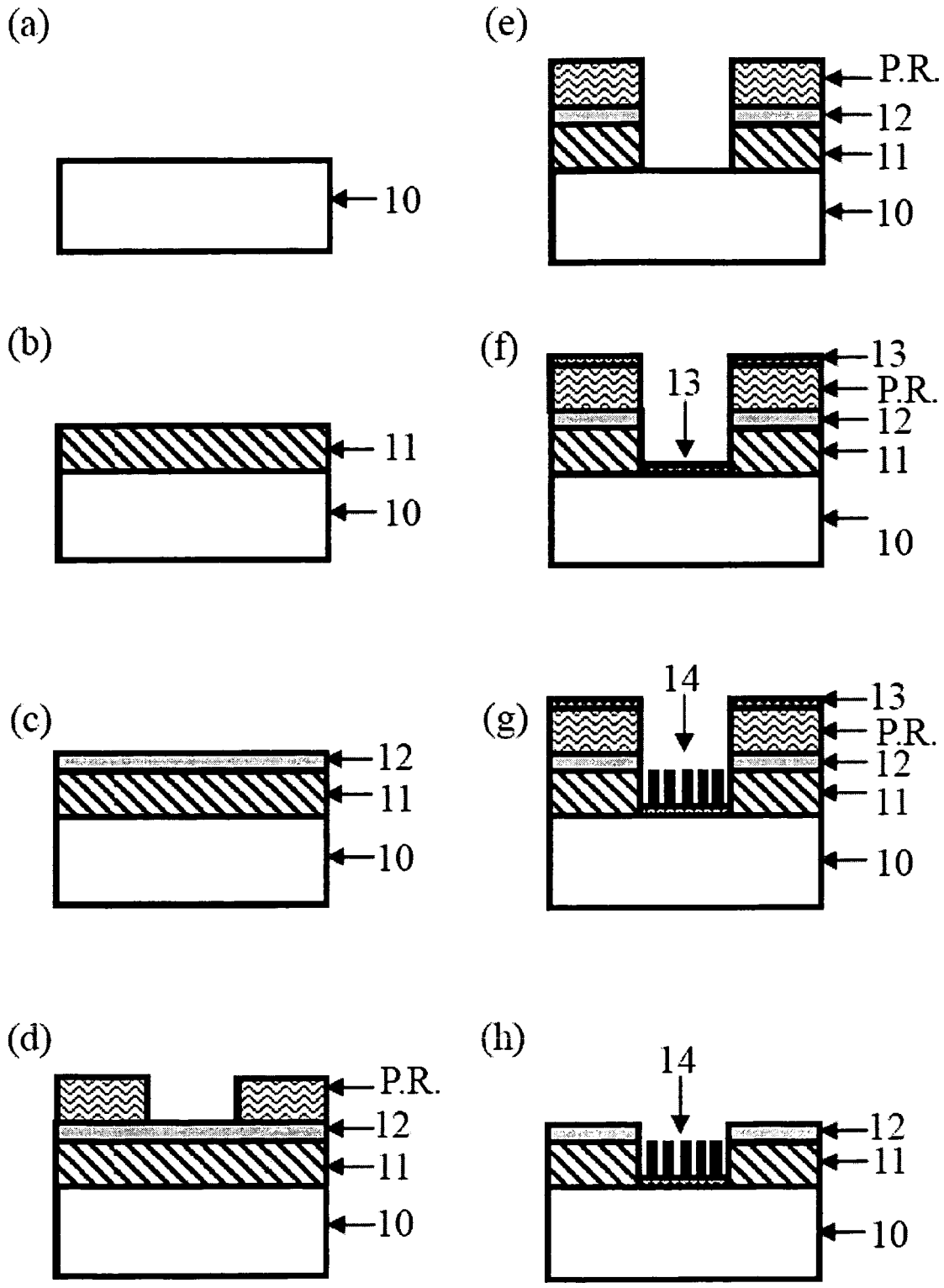
FIG. 1 is a schematic description of fabricating processes of field-emission triode.

In the text which follows, the invention is described by way of example on the basis of the following exemplary embodiments:

As shown in FIG. 1, (a) using a silicon substrate 10 as the support base of devices, and in order to enhance the adhesion between the substrate and the device film, conducting normal semiconductor R.C.A cleaning on the silicon substrate; (b) placing the substrate in the chamber for employing the Plasma Enhanced Chemical Vapor Deposition (PECVD) to fabricate the dielectric layer of $SiO_2$ 11 film; (c) conducting the evaporation deposition of aluminum film 12 for the gate electrode; (d) coating the photoresist on the film surface; (e) employing exposure and etching to sequentially etch the gate electrode layer and the dielectric layer to form a cavity; (f) employing the photoresist as a mask on the surface and using the sputtering method to deposit ZnO seeding layer 13 on the substrate surface and then removing the photoresistance layer, in which the unwanted seeding above the metal gate layer was lifted off; (g) using the hydrothermal method to grow ZnO nanowires 14 by putting the substrate into an aqueous solution of zinc nitrate hexanhydrate ($Zn(NO_3)_2.6H_2O$, 0.01M) and diethylenetriamine (HMTA, $C_6H_{12}N_4$, 0.01M) in a sealed vessel at 75° C. for 30 min., (h) obtaining the gate controlled field emission triode structure after cleaning and drying.

After the completion of device fabrication, the device is placed in argon atmosphere at the pressure of $10^{-4}$~$10^{-1}$ Torr for 1~100 times of bombardment on the ZnO nanowires to modify the top surface of ZnO nanowires.

[Result and Observation]

After the fabrication, the measurement of the ZnO nanowires gate controlled field emission triode is conducted. The measurement methods include the scanning electron microscope (SEM), X-ray diffraction analysis (XRD), transmission electron microscope (TEM), and field emission measurement for detailed investigation of crystal structure and surface morphologies of the ZnO nanowires and electrical characteristics of the devices.

Figure 2:
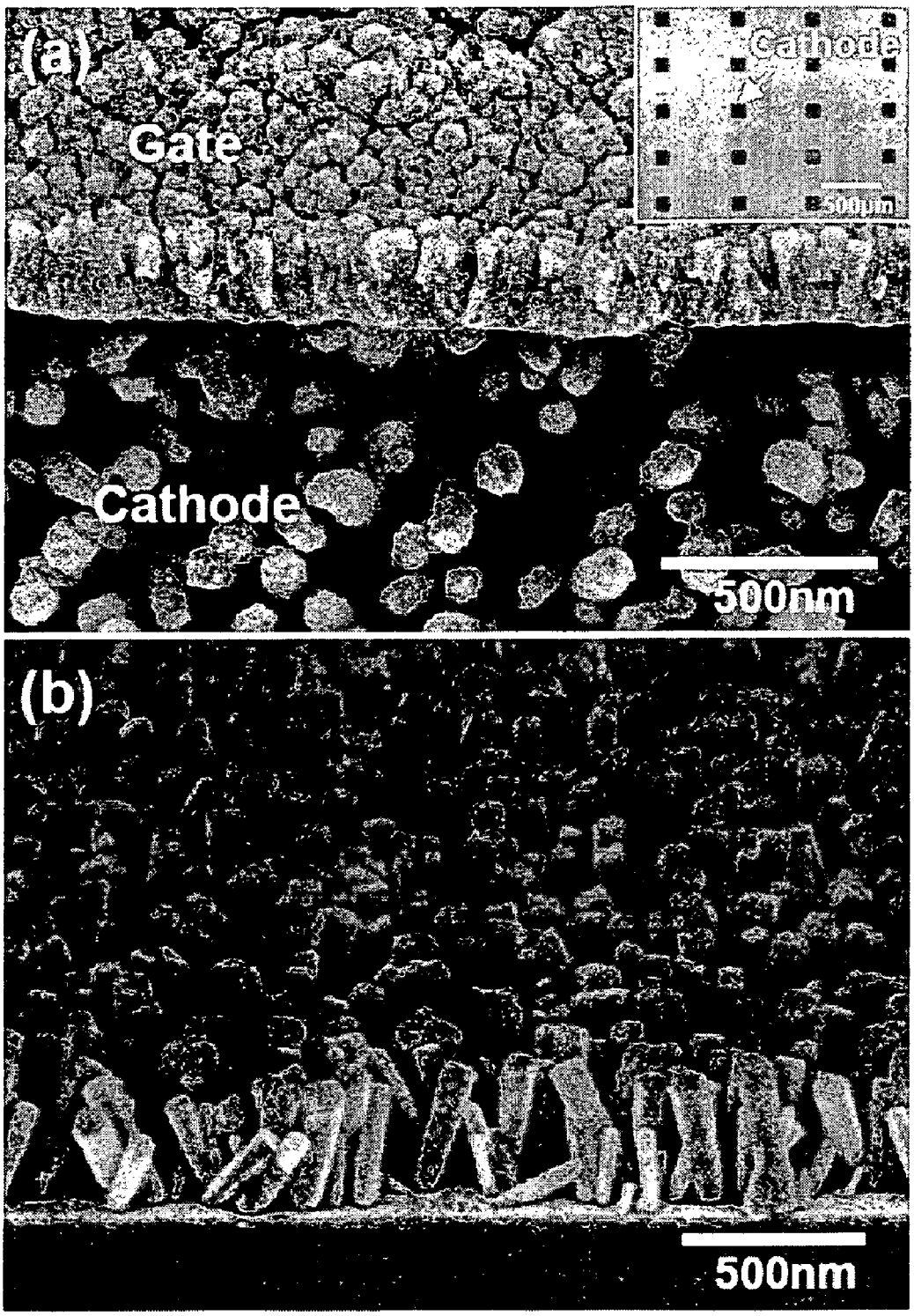
FIG. 2 (*a*) shows a FE SEM microphotograph of the triode near the gate edge. The inset is the 4×5 array triode with the ZnO nanowires islands grown inside gate holes. (b) shows a cross-sectional FE SEM image for ZnO nanowires fabricated according to the present invention.

FIG. 2 shows the SEM image of the fabricated ZnO-based triode structure, indicating that the cathode active region is 100×100 $\mu m^2$, and the distance between the two active regions is 500 μm. The gate region here is 2×2 $mm^2$. FIG. 2. (*a*) is the enlarged image of the triode device, in which well-aligned ZnO nanowires with a diameter of about 50 nm, a number density about $3.4\times10^{10}$ $cm^{-2}$ are uniformly grown on the ZnO seeding layer. FIG. 2(*b*) shows the average length of nanowires is about 500 nm.

Figure 3:
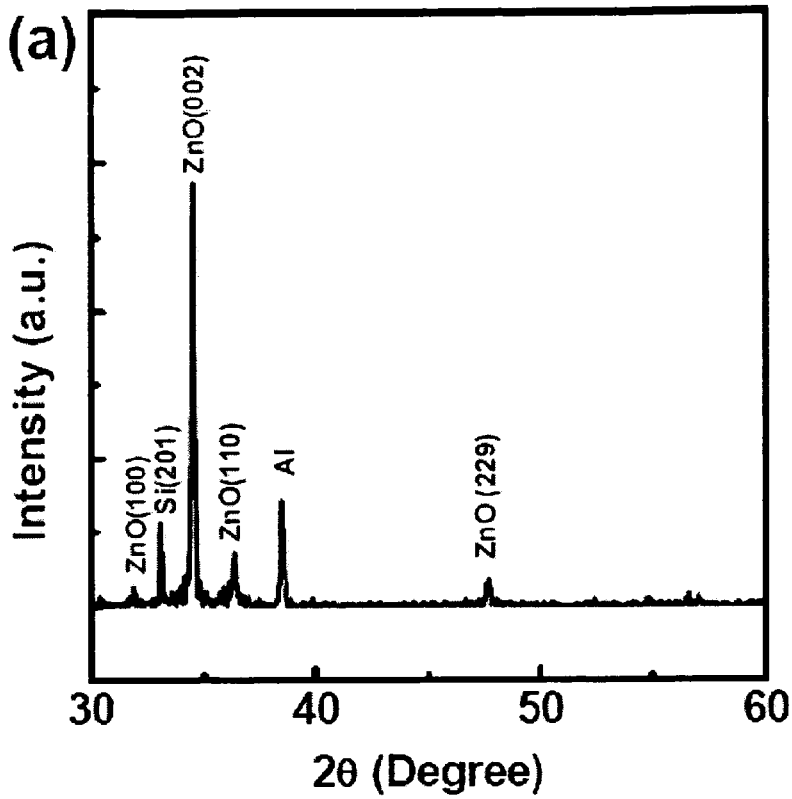
FIG. 3 (*a*) shows an X-ray diffraction pattern of ZnO nanowires fabricated at low temperature; and, (b) the transmission electron microscope micrograph and the selected area electron diffraction shown in the inset of FIG. 3(*b*).
Figure 3:
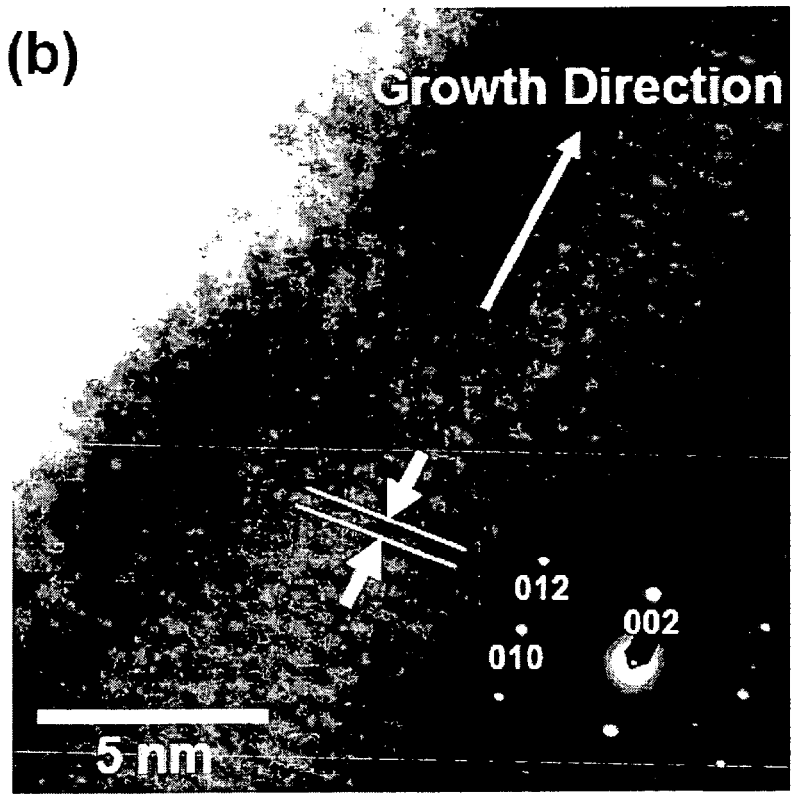

FIG. 3 illustrates the structural characteristics of ZnO nanowires fabricated at low temperature analyzed by using X-ray diffraction and transmission electron microscope respectively. In the X-ray diffraction pattern as shown in FIG. 3(*a*), the ZnO nanowires have (0002) preferred crystal orientation. FIG. 3(*b*) shows the transmission electron microscope image and the corresponding selected area electron diffraction pattern of the hydrothermally grown ZnO nanowires, illustrating the grown orientation and crystal structure of the nanowires. As shown in the figures, the ZnO nanowires grew uniformly along the [002] direction and the distance between parallel [002] lattice fringes of the ZnO nanowires is 5.21° A. The selected area electron diffraction pattern indexed in FIG. 3(*b*) shows that the ZnO nanowire is a single crystalline structure.

[Performance and Test]

Figure 4:
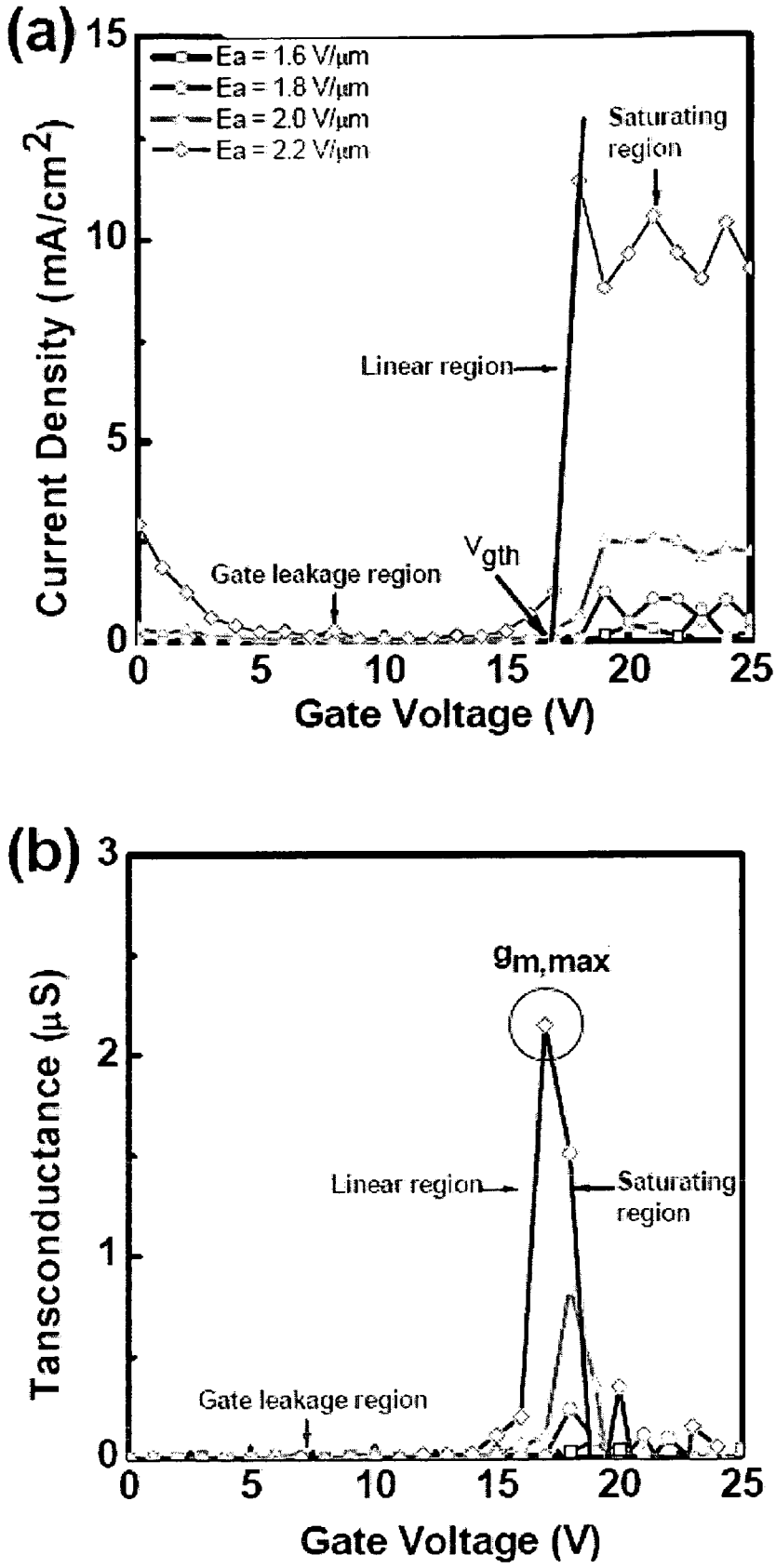
FIG. 4 indicates the field emission characteristics of field emission triode in the first embodiment according to the present invention, wherein (a) the relation between gate voltage and current density under the various applied electric field; (b) the relation of transconductance versus gate voltage; and (c) field emission current density versus applied electric field curves for gate voltage of 0, 10, 18V, respectively. The inset is the corresponding Fowler-Nordheim relation diagram.
Figure 4:
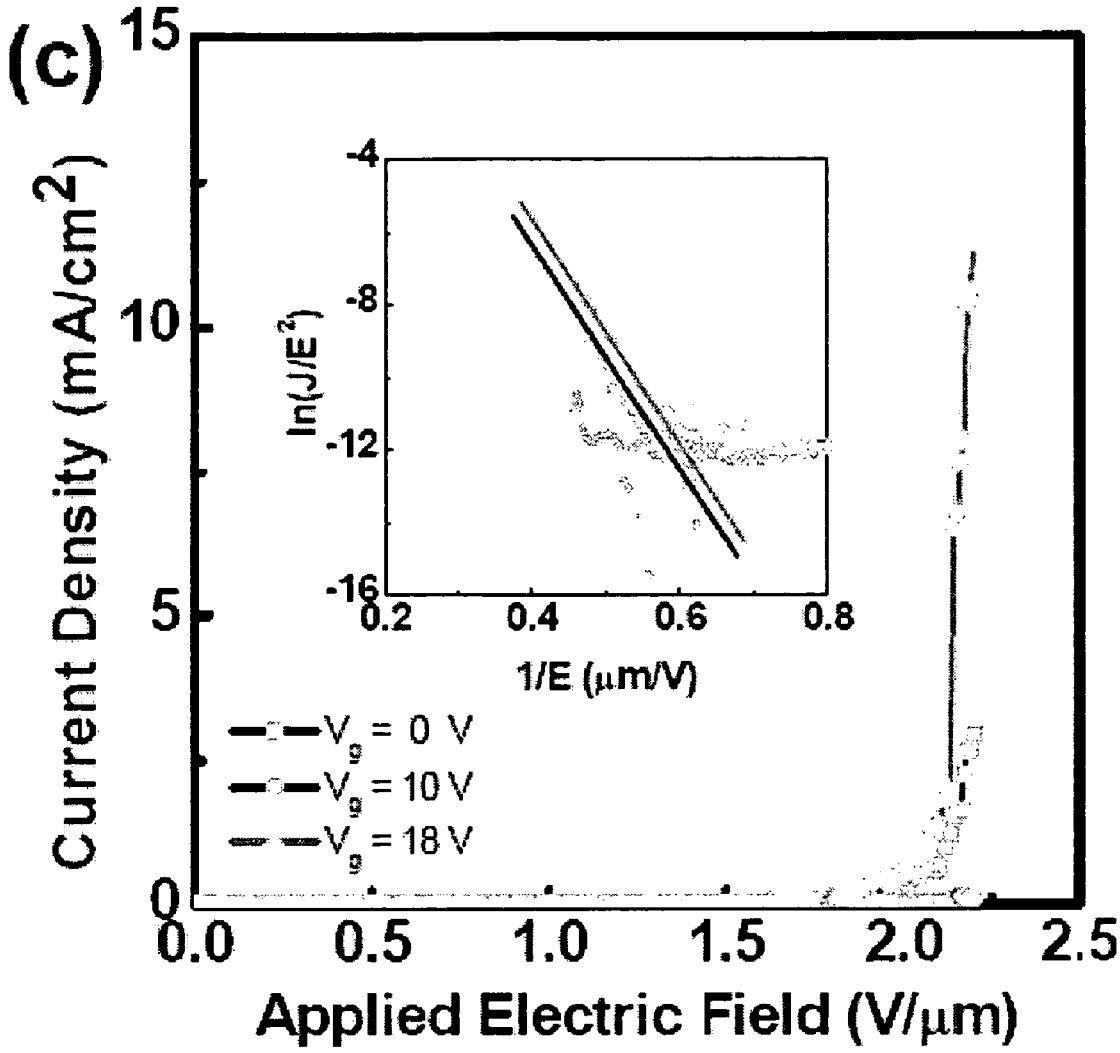

FIG. 4(*a*) illustrates the relationship between emission current density and gate bias, indicating that the controllable transistor behavior can be divided into three areas: gate leakage region, linear region, and saturation region. As the gate voltage is increased up to 14V, the current density abruptly increases in the linear region. The linear intercept on the Vg axis is defined as the threshold gate voltage of the linear region, $Vg_{th}$. The field emission characteristics can also be observed in the variation of the small single transconductance ($g_m$). FIG. 4(*b*) depicts the relationships between $g_m$ and Vg for the ZnO nanowires based field emission triode. The ZnO nanowires based triode of the transconductance, $g_m$ of 2.2 μs under the applied electric field of 2.2 $V\mu m^{-1}$ and a low operating gate voltage, $Vg_{th}$ of 17 V, which is the optimized operation voltage of the field emission triode. FIG. 4(*c*) shows the relationship between current density and applied electric field for the ZnO nanowires based triode for different gate voltage (Vg). The turn-on electric field ($E_{on}$, at a current density of 1.0 $\mu Acm^{-2}$) and threshold electric field ($E_{th}$, at a current density of 1.0 $mAcm^{-2}$) are 1.6 and 2.1 $V\mu m^{-1}$ under zero gate bias, respectively. As Vg increases to 10V, J is depressed to 36 $\mu Acm^{-2}$ under an Ea, of 2.2 $\mu m^{-1}$. The corresponding F-N plots ($\ln(J/E^2)$ v. $E^{-1}$) of the ZnO nanowires based triode are depicted in the inset of FIG. 4(*c*), indicating that the measured field emission characteristics fit the F-N relationships.

Figure 5:
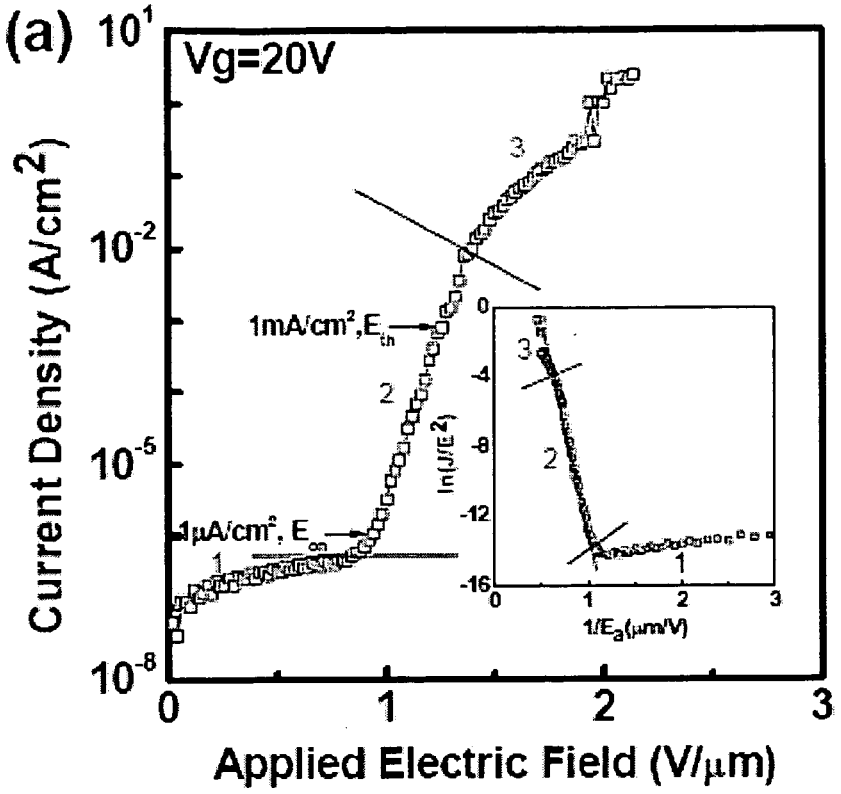
FIG. 5 depicts the field emission characteristics of the field emission triode under illumination in the first embodiment according to the present invention, and (a) the relation of current density versus applied electric field, at a gate voltage of 20 V, and the inset shows corresponding Fowler-Nordheim relation diagram, and (b) the relation of photo-enhanced field emission current density versus gate voltage under various electric fields; and the insert shows the relation of transconductance versus gate voltage under electric field of 2.2 V/μm.
Figure 5:
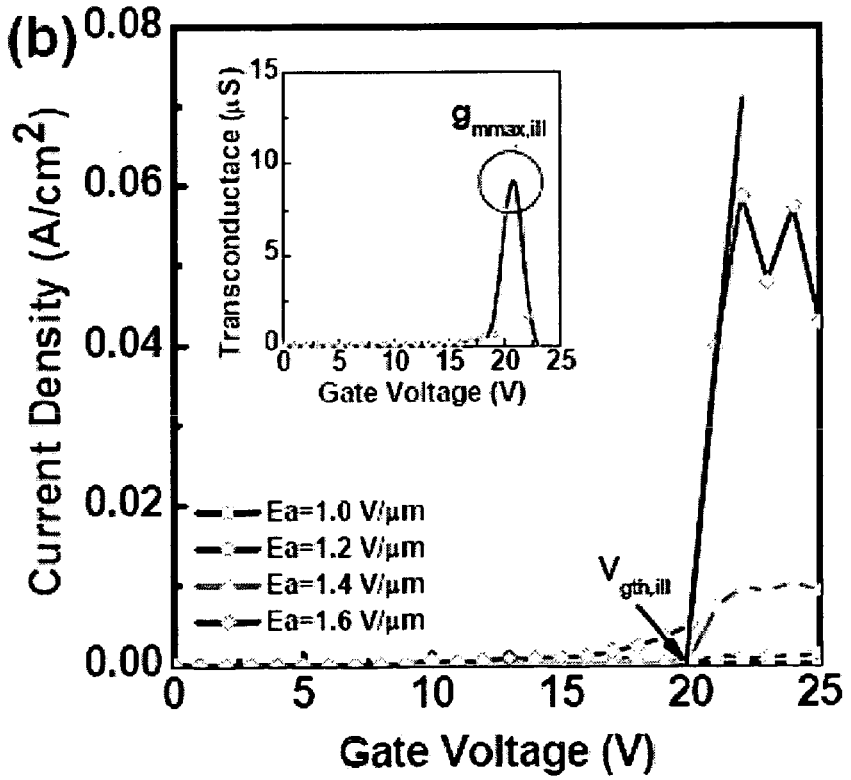

The triode operating in the saturation region exhibits typical field emission characteristics under illumination as shown in FIG. 5(*a*). This J-E curve can also be divided into three parts: zero emission (region 1 of FIG. 5(*a*), F-N field emission (region 2) and current saturation regions (region 3)). The β value (3050) of the illumination ZnO nanowires based field emission triode calculated from the slopes of the F-N relationships inset in FIG. 5(*a*) is close to that of the dark one.

The J-Vg plots with various fields Ea for a triode under 30 W incandescent lamp irradiation are shown in FIG. 5(*b*). There is a large increase in the field emission current density under the optical illumination and the threshold gate bias of the triode operated under the illumination is about 20 V. The average current density in the off region under the field Ea of 2.2 $V\mu m^{-1}$ is about 0.1 $mAcm^{-2}$, while that in the on region is about 0.5 $Acm^{-2}$. Thus, the triode exhibits controllable field emission characteristics under illumination, and the on/off current density ratio of this triode is about 5,000 under the anode electric field of 2.2 $V\mu m^{-1}$. The inset in FIG. 5(*b*) shows the relationship between $g_m$ and Vg with an Ea of 1.6 $V\mu m^{-1}$ under illumination; this exhibits a high $g_m$ of 10 μs under the anode field of 1.6 $V\mu m^{-1}$ and a gate bias of 20 V, which is the optimized operation voltage for such a triode. Moreover, the μ value is about 200 under 2 $mAcm^{-2}$.

Figure 6:
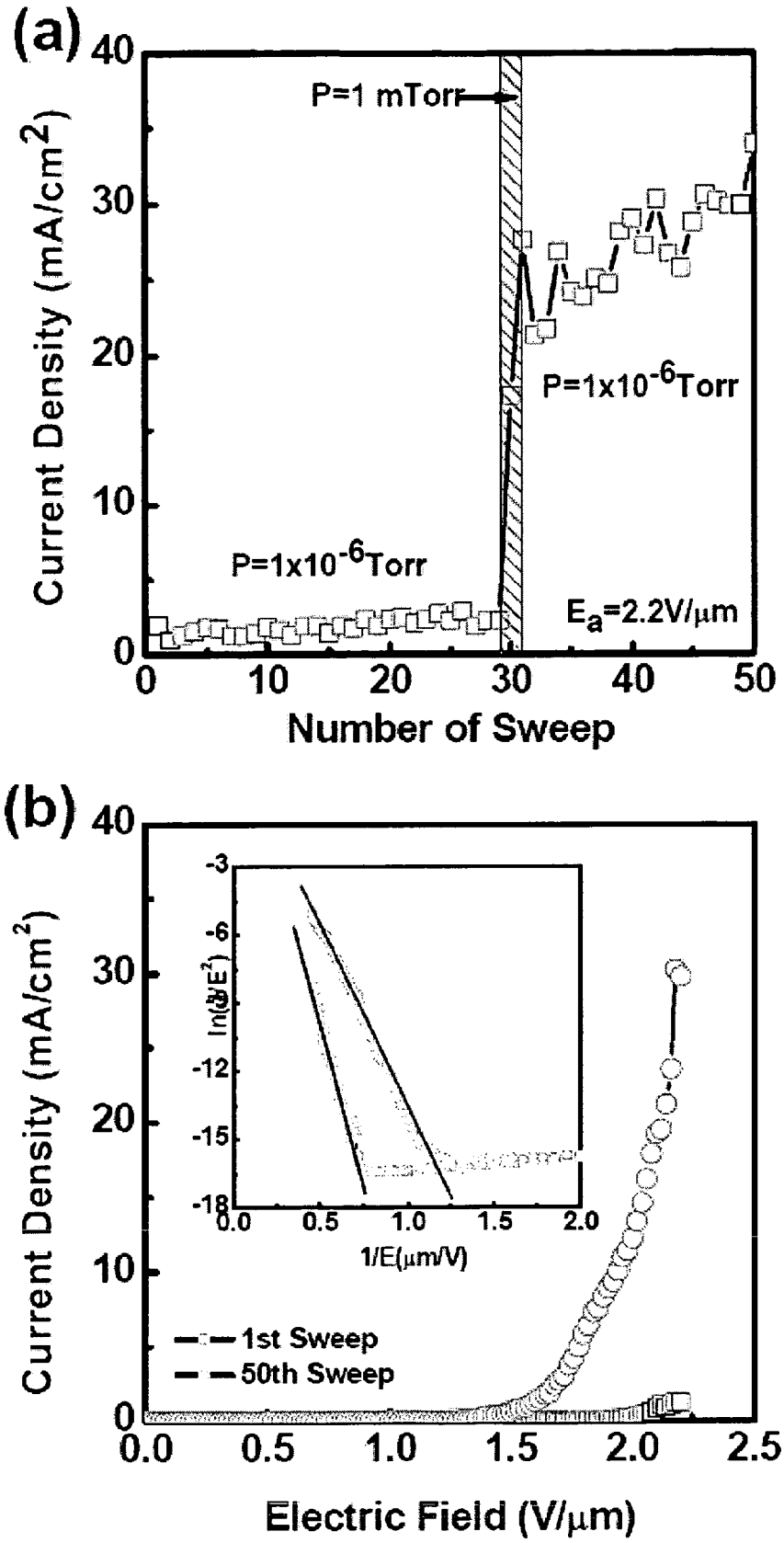
FIG. 6 (*a*) the field emission current density of the ZnO nanowires based field emission triode under various pressures; and, (b) the 1th and $50^{th}$ sweeps of current density versus applied electric field curves, and the inserted figure is the Fowler-Nordheim relation diagram.

FIG. 6 shows the field emission characteristics of the triode measured under various pressures, obtained to investigate the influence of the measuring pressure on the characteristics. This ZnO nanowires based triode was swept from 0 to 2.2 $V\mu m^{-1}$ with a Vg of 0 V (avoiding the effects from the gate) under $1\times10^{-6}$ Torr in the first 29 operations. In the first 29 tests, the field emission current densities are similar to those obtained with the average current density of 2 $mAcm^{-2}$. Then, the following two sweeps were carried out under $1\times10^{-3}$ Torr with Ar gas flowing in, and the current density is abruptly increased to 27 $mAcm^{-2}$. Finally, the pressure was decreased to $1\times10^{-6}$ Torr again, for the last 19 operations and the field emission current density remains at the average value of 27 $mAcm^{-2}$, which shows a significant increase in comparison with that in the first 29 tests under the same measuring pressure. The field emission characteristics of the $1^{st}$ and $50^{th}$ sweeps of the triode are depicted in FIG. 6(*b*), indicating that the $E_{th}$ of the first sweep is 2.1 $V\mu m^{-1}$ while that of the $50^{th}$ sweep is 1.6 $V\mu m^{-1}$. The calculated β value of the $50^{th}$ sweep of this triode device is 5203. Thus, such a triode exhibits better emission properties, including low turn-on and threshold electric fields, high emission current density and a high β value after the measurement at the high pressure of $1\times10^{-3}$ Torr.

Figure 7:
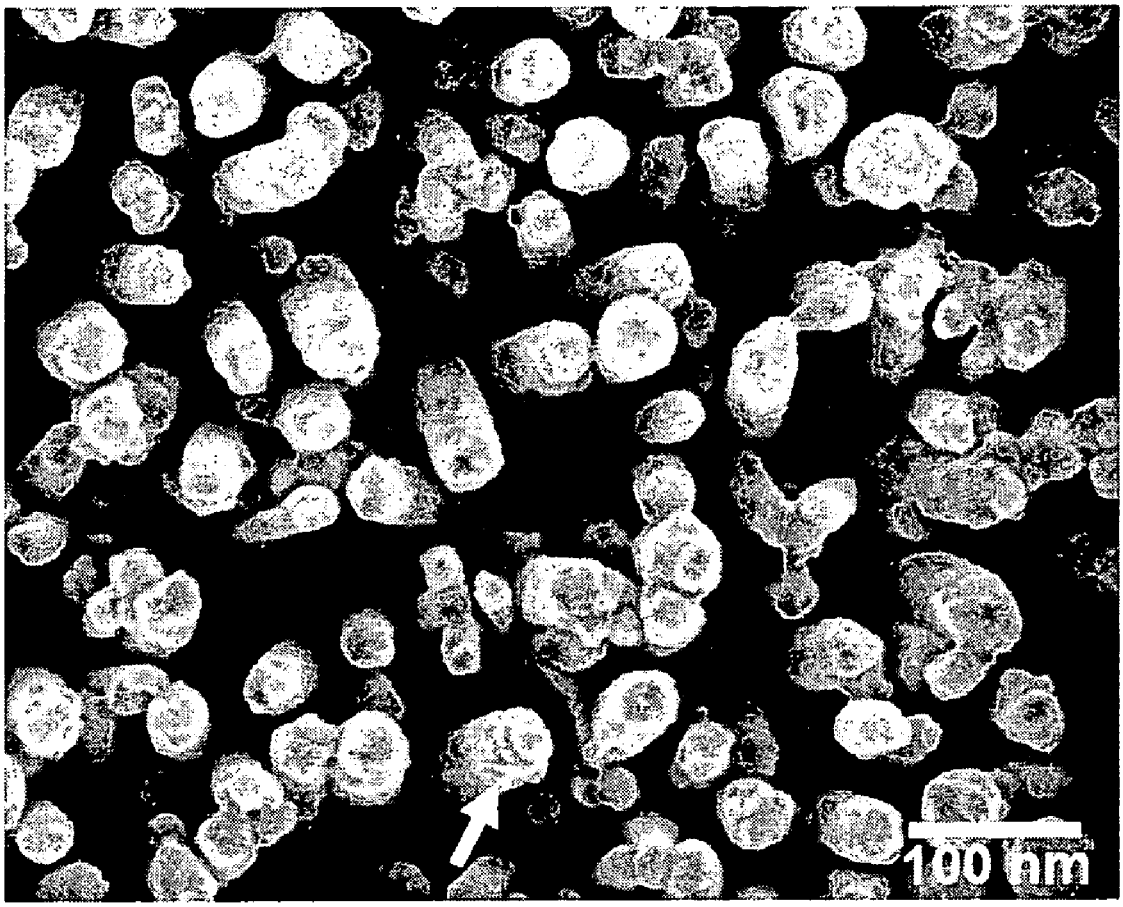
FIG. 7 shows FE SEM images of ZnO nanowires after measuring in high pressure and sweeping 50 times, indicating that these nanowires measured under high pressure were bombarded with argon ions leading to the formation of smaller tips at the front of the nanowires FIG. 8 (*a*) shows field emission current density versus electric field curves of $Mg_{0.1}Zn_{0.9}O$(MZO) and phosphorus-doped MZO nanowires, and (b) the corresponding Fowler-Nordheim plots of the nanowires.
Figure 8:
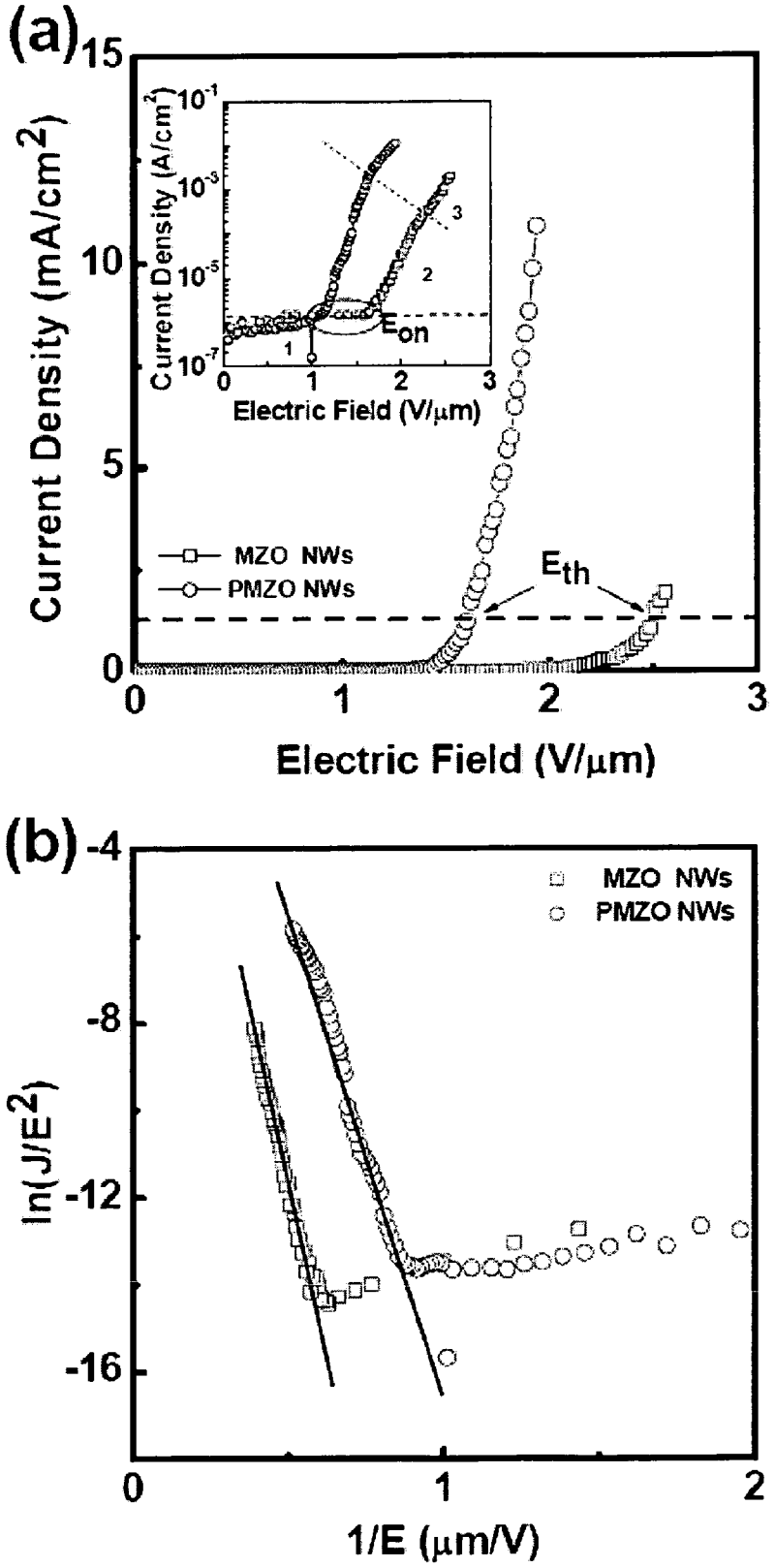

The field emission ability and β value strongly depend upon the morphology of the ZnO nanowires. FIG. 7 shows the FE-SEM image of the ZnO nanowires after measuring in high pressure and sweeping 50 times, including that these ZnO nanowires have smaller tips than the original ones (FIG. 2). It is suggested that these ZnO nanowires measured under high pressure were bombarded with argon ions leading to the formation of smaller tips at the front of the nanowires. Therefore, the observed improved emission properties of the triode are mainly due to such smaller tips of ZnO nanowires. Moreover, these ZnO nanowires exhibit the better field emission ability and higher β value than ZnO nanowires synthesized by the hydrothermal method (β~550) and ZnO nanoneedles formed by Ar ion bombardment (β~1134). This result also provides a possible simple method for enhancing the field emission properties of ZnO nanowires based triodes. The field emission characteristics of the MZO($Mg_{0.1}Zn_{0.9}O$) and PM(phosphorus-doped)ZO nanowires on the p-type Si(100) substrate are shown in FIG. 8. As shown in FIG. 8, the turn-on electric field ($E_{on}$, under the current density of 1.0 $\mu A/cm^2$) and threshold electric field ($E_{th}$, under the current density of 1.0 $mA/cm^2$) of MZO nanowires are 1.3 and 1.9 V/μm, respectively, while those of PMZO nanowires are 1.0 and 1.5 V/μm, respectively. The semi-logarithmic plots of J-E field-emission characteristics shown in the insert of FIG. 8(*a*) further identify their emission properties. These plots can be divided into three parts: zero emission (region 1), Fowler-Nordheim (F-N) field emission (region 2), and current saturation region (region 3). The $E_{on}$ is defined as the electric field for which tunneling of PMZO nanowires occurs and is 1.0 V/μm which is lower than that of PMZO nanowires (1.3 V/μm). Above $E_{on}$ (region 2), the emission current density increases and then saturates at the high electric-field region (region 3). The current density emitted by MZO nanowires is lower than by PMZO nanowires under the same electric field. A knee electric field, $E_{knee}$, is defined as the demarcation point between F-N field-emission and current saturation regions. The $E_{knee}$ of MZO and PMZO nanowires, respectively are 1.8 and 1.5 V/μm. In this F-N tunneling region, the better field-emission properties were observed for the PMZO as compared with MZO because the resistance of PMZO is smaller. This worse field-emission ability of MZO may be due to a potential barrier formed by the negative charge in the surface state of n-type emitters. Thus, the p-type PMZO nanowires with lower surface state barrier perform the better field-emission properties. The MZO and PMZO nanowires on p-type Si substrate at a saturation region at higher electric field (region 3) in the J-E plot. This saturation region exists due to the high resistance in the series of semiconductor emitters. As shown in the inset of FIG. 8(*a*), the resistance in series of MZO and PMZO nanowires are introduced to fit the J-E plot and the values of 93 and 62 kΩ are obtained, respectively. The decreasing resistance in the series of PMZO nanowires is attributed to a lower potential barrier formed by the positive charged in the surface state of p-type PMZO emitters. Obviously, the P dopant can improve the field-emission properties of MZO nanowires on the p-type Si(100) substrate. The PMZO nanowires with the low threshold electric field and low resistance in series are suitable for the field-emission applications.

The corresponding F-N plots [$\ln(J/E^2)v\cdot E^{-1}$] of the MZO and PMZO nanowires on the p-type Si(100) substrate are depicted in FIG. 8(*b*), indicating that the measured field-emission characteristics fit the F-N relationship. The F-N relationship is as follows:

$$J=(A\beta^2E^2/\psi)\times\exp(-B\psi^{3/2}/\beta E), \quad (1)$$

where J is the current density, E the applied field, ψ the work function of the ZnO (5.37 eV), β the field enhancement factor, $A=1.56\times10^{-10}(AV^{-2}\ eV)$, and $B=6.83\times10^3\ (V\ eV^{-3/2}\ \mu m^{-1})$. The calculated β value of MZO nanowires is 3048, and that of PMZO nanowires is 3054. Therefore, the β value of PMZO nanowires is close to that of MZO nanowires.

The ZnO nanowires field emission triode structure fabricated by the above-mentioned method could employ the ion doping to change the conductivity of the ZnO nanowires itself, and the high pressure Ar ions bombardment to modify the surface of ZnO nanowires, reduce the tip radius, and achieve the effect of improving field enhancement factor, reducing the turn on electric field and the threshold electric field and device performance.

The suitable substrate material for the present invention includes various types of substrates durable for semiconductor process. The gate opening fabricated according to the present invention could be arbitrarily adjusted, and the fabrication of large-scale device could also be conducted with this method.

Comparing the present invention with the prior art, the present invention provides the following advantages: low temperature processing, low fabrication cost, large-area uniformity, and only one mask for defining the anode activation area. The process in the present invention is simple and practicable. The present invention employs one mask for defining the location for the gate and anode oxidation area, and also for defining the location for the following field emission emitter. Furthermore, the present invention employs the Ar gas bombardment to modify the tip of ZnO nanorods, and improve the field emission characteristic after completion of device fabrication.

Thus, the present invention certainly has better effect than the prior art, and the process according to the present invention is simple and practicable, which could significantly reduce the fabrication cost, and provide the industrial application value, so as to issue the invention patent application.

Having illustrated and disclosed the preferred embodiments according to the present invention, those skilled in the art should appreciate that these embodiments did not limit the present invention, and numerous changes and modifications may be made to these embodiments of the prevent invention, and that such changes and modifications may be made without departing from the spirit and scope of the present invention. Therefore, the protection scope of the present invention is defined by the appended claims.

EXPLANATION OF MAIN COMPONENTS

10 Substrate
11 Dielectric layer
12 Conductive gate layer
13 Seeding layer
14 ZnO nanowires array
P.R. Photoresist

We claim:

1. A method for vertically growing ZnO nanowires on a semiconductor substrate, which employs the hydrothermal method to immerse the substrate deposited with ZnO seeding layer into an aqueous solution containing zinc nitrate hexahydrate and diethylenetriamine at about 0.01M~0.5M with the help of a heater to maintain the stable reaction temperature at 75~95° C., and the reaction time at 0.5~3 hours.

2. A method according to claim 1, wherein the control of the geometric shape or structure of the nanowires, in the fabrication process for the solution, employs the salt-type ion solution as additives and adjusts the pH value as the conditional parameters for the control.

3. A method according to claim 1, wherein the aqueous solution having zinc nitrate hexahydrate and diethylenetriamine is added with metal salt consisting of Al, Ge, Mg, or P, to reduce the resistance of ZnO nanowires.

4. A ZnO nanowire fabricated with the method according to claim 1, which are vertical to the substrate surface and have the diameter of 30~100 nm, the length of 500~3000 nm, and high aspect ratio.

* * * * *